US006364426B1

(12) United States Patent
Horne et al.

(10) Patent No.: US 6,364,426 B1
(45) Date of Patent: Apr. 2, 2002

(54) VEHICLE WHEEL HUB AND BEARING UNIT ASSEMBLY AND METHOD FOR PRODUCING SAME

(75) Inventors: David M. Horne, Waterford; Walter A. Santarossa, Fraser, both of MI (US)

(73) Assignee: Kelsey-Hayes Company, Livonia, MI (US)

( * ) Notice: Subject to any disclaimer, the term of this patent is extended or adjusted under 35 U.S.C. 154(b) by 0 days.

(21) Appl. No.: 09/369,101

(22) Filed: Aug. 5, 1999

Related U.S. Application Data

(60) Provisional application No. 60/095,364, filed on Aug. 5, 1998.

(51) Int. Cl.[7] ..... B60S 1/62; B62D 25/16; F16C 13/00; B21D 53/10; F16D 65/10

(52) U.S. Cl. ..... 301/105.1; 384/544; 29/898.09; 188/218 XL

(58) Field of Search ..... 301/105.1 I, 126, 301/131, 132; 384/544, 537, 584; 29/894.012, 894.36, 894.362, 898, 898.054, 898.09; 188/218 XL

(56) References Cited

U.S. PATENT DOCUMENTS 1,693,067 A * 11/1928 Williams ..... 301/105.1
1,876,393 A * 9/1932 Booth ..... 301/105.1
3,237,288 A * 3/1966 Hogan et al. ..... 29/894.362
5,209,701 A * 5/1993 Ishikawa et al. ..... 384/544
5,443,316 A * 8/1995 Deane et al. ..... 384/485
5,447,463 A * 9/1995 Schmitz ..... 29/894.362
5,779,518 A * 7/1998 Schmitz ..... 29/894.362
5,863,239 A * 1/1999 Barton, II ..... 29/894.36
5,884,980 A * 3/1999 Visser et al. ..... 301/105.1
5,984,422 A * 11/1999 Seifert ..... 301/105.1
6,035,507 A * 3/2000 Bianchi ..... 29/894.36
6,071,180 A * 6/2000 Becker ..... 29/894.362
6,089,673 A * 7/2000 Wiacek et al. ..... 301/105.1

* cited by examiner

*Primary Examiner*—S. Joseph Morano
*Assistant Examiner*—Jason R. Bellinger
(74) *Attorney, Agent, or Firm*—MacMillan, Sobanski & Todd, LLC

(57) ABSTRACT

This invention relates to an improved vehicle wheel hub and bearing unit assembly and method for producing the same wherein an outer brake rotor mounting surface of the wheel hub and bearing assembly is subjected to a microfinishing process. The method for producing the vehicle wheel hub and bearing assembly comprises the steps of: (a) providing a vehicle wheel hub including an inboard end, an outboard end, and a main body having a radially outwardly extending flange, the flange having an outer surface which defines an outer brake rotor mounting surface of the vehicle wheel hub; (b) providing a bearing unit to rotatably support the vehicle wheel hub relative thereto; (c) assembling the bearing unit onto the vehicle wheel hub to produce a vehicle wheel hub and bearing unit assembly which defines a longitudinal axis; (d) preloading the bearing unit; (e) providing a microfinishing assembly having a microfinishing wheel; (f) supporting the vehicle wheel hub and bearing assembly on the microfinishing fixture; and (g) operating the microfinishing fixture whereby the microfinishing wheel engages the outer brake rotor mounting surface of the vehicle wheel hub and bearing unit assembly to produce a finished vehicle wheel hub and bearing assembly, the outer brake rotor mounting surface of the finished vehicle wheel and bearing unit assembly being microfinished relative to the longitudinal axis of the vehicle wheel hub and bearing unit assembly.

21 Claims, 7 Drawing Sheets

FIG. 11
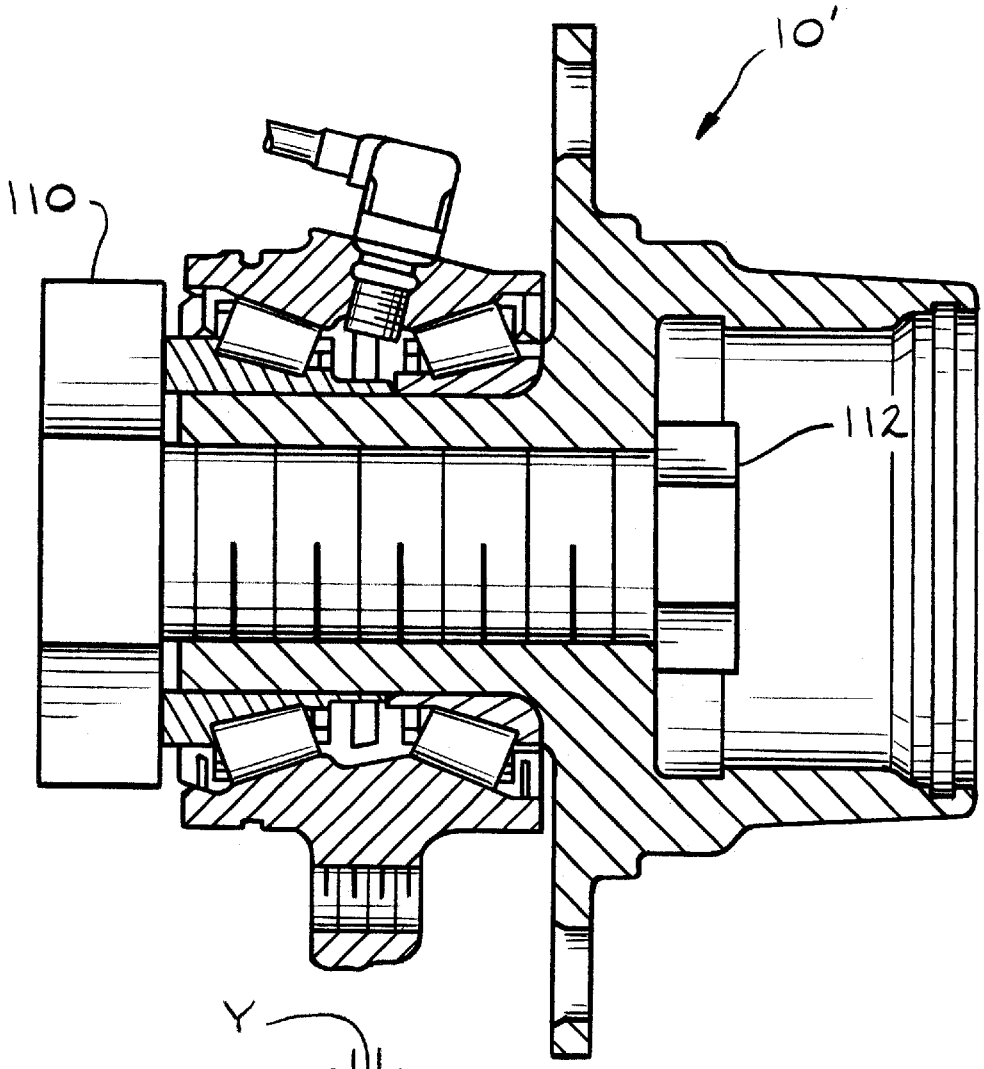
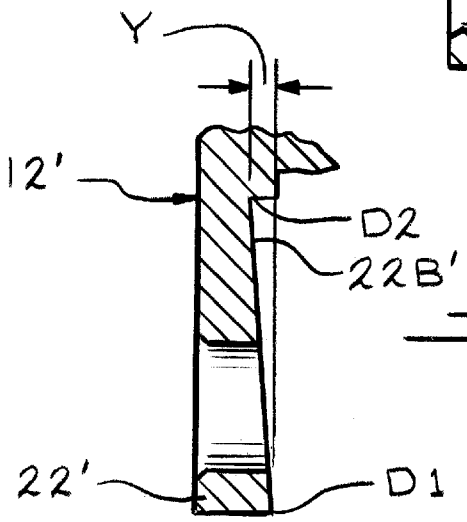
FIG. 12

VEHICLE WHEEL HUB AND BEARING UNIT ASSEMBLY AND METHOD FOR PRODUCING SAME

CROSS-REFERENCE TO RELATED APPLICATIONS

This application claims the benefit of U.S. Provisional Application Ser. No. 60/095,364, filed Aug. 5, 1998.

BACKGROUND OF THE INVENTION

This invention relates in general to vehicle brakes and in particular to an improved vehicle wheel hub and bearing unit assembly and method for producing the same.

A conventional vehicle wheel hub and bearing unit assembly associated with a driven front wheel of a vehicle includes a wheel hub and a bearing unit assembly. The wheel hub includes a generally stepped main body having an opened inboard end, an opened outboard end, and a generally axially extending main body. The main body of the wheel hub includes internal splines for receiving mating external splines provided on an axle for rotatably connecting the wheel hub to the axle for rotation therewith. The main body of the wheel hub also includes a generally radially outwardly extending flange having a plurality of circumferentially spaced apart stud receiving holes formed therein. The stud receiving holes receive wheel studs and nuts for securing a brake rotor of a disc brake assembly and a vehicle wheel to the flange of the wheel hub for rotation therewith. Alternatively, the stud receiving holes in the wheel hub flange can be threaded and receive threaded bolts for securing the brake rotor and/or the vehicle wheel to the flange of the wheel hub for rotation therewith.

The vehicle wheel hub is also provided with a bearing seat for receiving the associated bearing unit. The bearing unit includes an inner race and an outer race. The outer race of the bearing unit includes a generally radially outwardly extending flange having a plurality of circumferentially spaced apart stud receiving holes formed therein. The stud receiving holes of the bearing unit flange receive studs and nuts for securing the outer race to a steering knuckle of a vehicle so as to rotatably support the wheel hub relative thereto.

When used with a preassembled cartridge type of bearing unit, a fully machined wheel hub and a fully machined brake rotor are assembled and installed on a vehicle in the following manner. First, the cartridge bearing unit is installed about the bearing seat of the wheel hub in a press-fit relationship therewith. The cartridge bearing unit can either be a pregreased sealed-for-life cartridge bearing, or of the type having a pair of bearing elements, either ball bearings or tapered roller bearings, disposed between an inner bearing race or cup and an outer bearing race or cup.

Once the bearing unit is installed about the wheel hub, a nut is threaded onto the end of the wheel hub and tightened to pre-load the bearing unit assembly to predetermined specifications. Next, the assembled wheel hub and bearing assembly is secured to the steering knuckle for rotation relative thereto. Following this, a brake rotor of a disc brake assembly and a vehicle wheel are secured to the flange of the wheel hub for rotation therewith. Next, the disc brake assembly, which includes a brake caliper slidably supported on a pair of pins, the pair of brake pads, and a hydraulically actuable piston, is secured via an anchor plate to a fixed part of a vehicle.

When fully assembled on the vehicle, a pair of opposed friction plates of the brake rotor are disposed adjacent the brake pads of the disc brake assembly and separated from engagement therewith by a predetermined normal brake running clearance when the piston is not actuated. During operation, when the piston of the disc brake assembly is actuated, the brake shoes take up the normal running clearance and frictionally engage the friction plates.

In order to provide the normal brake running clearance, the brake rotor needs to be manufactured to tight specifications. In particular, the brake friction plate surfaces need to be oriented in a perpendicular relationship relative to the axis of the rotor, and in a parallel relationship relative to one another. If these tight specifications are not maintained in the friction plate surfaces, excessive lateral or axial runout or excessive thickness variations in the friction plate surfaces of the rotor can occur which can lead to undesirable results. For example, premature or uneven wear of the brake pads can occur which can cause undesirable noise, vibration, or brake shudder.

As discussed above, the brake rotor is secured to the wheel hub. In particular, an inner brake rotor mounting surface of the brake rotor is disposed adjacent an outer brake rotor mounting surface of the wheel hub when the brake rotor is secured to the wheel hub. Typically, the outer brake rotor mounting surface of the wheel hub is machined by a conventional lathe machining process. Thus, when fully assembled on the vehicle, the total "stack up" axial runout of the friction plate surfaces of the brake rotor is the sum of the axial runout of the friction plate surfaces of the brake rotor, the axial runout of the associated outer brake rotor mounting surface of the wheel hub, the axial runout of the associated vehicle wheel hub bearing unit, and any deflection caused by the "clamping" of the associated vehicle wheel.

SUMMARY OF THE INVENTION

This invention relates to an improved vehicle wheel hub and bearing unit assembly and method for producing the same wherein an outer brake rotor mounting surface of the wheel hub and bearing assembly is subjected to a microfinishing machining process. The method for producing the vehicle wheel hub and bearing assembly comprises the steps of: (a) providing a vehicle wheel hub including an inboard end, an outboard end, and a main body having a radially outwardly extending flange, the flange having an outer surface which defines an outer brake rotor mounting surface of the vehicle wheel hub; (b) providing a bearing unit to rotatably support the vehicle wheel hub relative thereto; (c) assembling the bearing unit onto the vehicle wheel hub to produce a vehicle wheel hub and bearing unit assembly which defines a longitudinal axis; (d) preloading the bearing unit; (e) providing a microfinishing assembly having a microfinishing wheel; (f) supporting the vehicle wheel hub and bearing assembly on the microfinishing fixture; and (g) operating the microfinishing fixture whereby the microfinishing wheel engages the outer brake rotor mounting surface of the vehicle wheel hub and bearing unit assembly to produce a finished vehicle wheel hub and bearing assembly, the outer brake rotor mounting surface of the finished vehicle wheel and bearing unit assembly being microfinished relative to the longitudinal axis of the vehicle wheel hub and bearing unit assembly. As a result, the vehicle wheel hub and bearing unit assembly of this invention includes an outer brake rotor mounting surface which is of a near gage quality surface.

Other advantages of this invention will become apparent to those skilled in the art from the following detailed description of the preferred embodiments, when read in light of the accompanying drawings.

BRIEF DESCRIPTION OF THE DRAWINGS

FIG. 11 is a sectional view illustrating a second embodiment of a vehicle wheel hub and bearing unit assembly in accordance with this invention.

FIG. 12 is a sectional view of a portion of the flange of a portion of a third embodiment a vehicle wheel hub and bearing unit assembly in accordance with this invention.

DETAILED DESCRIPTION OF THE PREFERRED EMBODIMENTS

Figure 1:
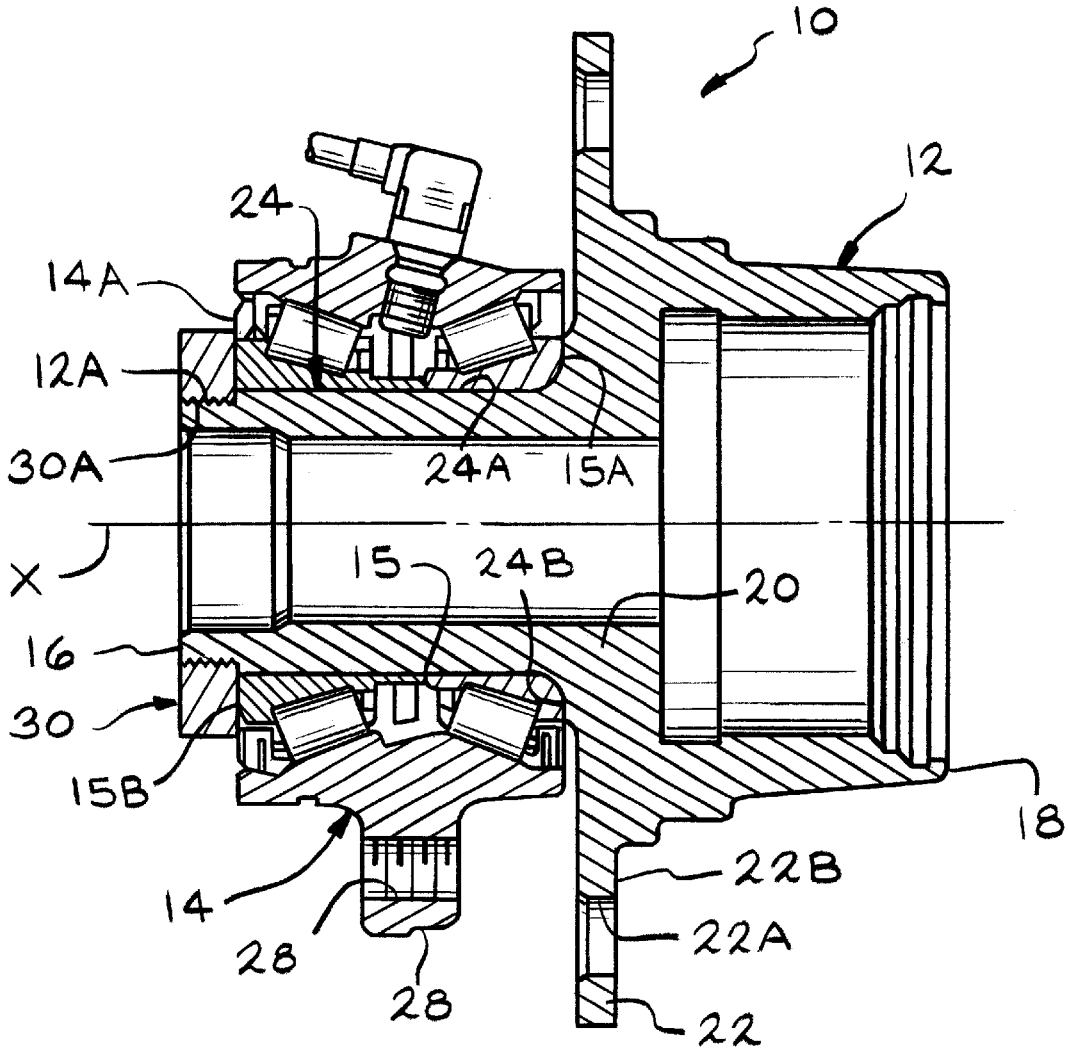
FIG. 1 is a sectional view of a first embodiment of a vehicle wheel hub and bearing unit assembly in accordance with this invention.

Referring to the drawings, there is illustrated in FIG. 1 a first embodiment of a vehicle wheel hub and bearing unit assembly, indicated generally at 10, produced in accordance with this invention. As shown therein, the vehicle wheel hub and bearing unit assembly 10 defines a longitudinal axis X and includes a vehicle wheel hub 12 and a bearing unit 14. The vehicle wheel hub 12 can be forged, cast, or otherwise formed.

The vehicle wheel hub 12 includes a generally stepped main body having an opened inboard end 16, an opened outboard end 18, and a generally axially extending main body 20 having a generally radially outwardly extending flange 22. The flange 22 extends generally perpendicular to the longitudinal axis X of the vehicle wheel hub and bearing unit assembly 10. The vehicle wheel hub 12 is provided with a bearing seat 24 for receiving the bearing unit 14. The bearing seat 24 includes a generally axially extending bearing seat surface 24A and a generally radially extending bearing seat surface 24B. As will be discussed below, in accordance with the present invention, the flange 22 of the vehicle wheel hub 12 includes an outer surface 22B which defines an outer brake rotor mounting surface 22B which is finish machined by a microfinishing or microgrinding process in order to produce the vehicle wheel hub and bearing unit assembly 10 of this invention. As used herein, the term microfinishing or microgrinding means a process which exerts a relatively low force onto the part and which is operative to change the associated surface geometry of such part. As will be discussed below, in accordance with the present invention the metal removed from the outer brake rotor mounting surface 22B of the flange 22 of the wheel hub 12 during the microfinishing process is approximately in the range from about 5 microns to about 200 microns.

The flange 22 of the vehicle wheel hub 12 has a plurality of circumferentially spaced lug bolt receiving holes 22A formed therein (only two of such lug bolt receiving holes 22A are illustrated in FIG. 1). As will be discussed below, a lug bolt 26 (shown in FIG. 4), is disposed in each of the lug bolt receiving holes 22A to secure a disc brake rotor 60 (shown in FIG. 4), and a vehicle wheel (not shown) to the vehicle wheel hub 12 for rotation therewith. In some cases, the outboard end 18 of the vehicle wheel hub 12 is adapted to receive a dust cover (not shown) to prevent dirt, mud, water, and other debris from entering into the interior of the vehicle wheel hub 12 through the opened outboard end 18.

Also, as shown in this embodiment, the outer brake rotor mounting surface 22B of the flange 22 of the wheel hub 12 defines a generally flat surface. Alternatively, the profile of the surface of the outer brake rotor mounting surface 22B can be other than illustrated. For example, the outer brake rotor mounting surface 22B can have a non-flat surface profile which can include for instance, a generally tapered, convex, spherical, curved, or concave profile. FIG. 12 illustrates an example of a tapered profile, shown exaggerated for clarity and discussion purposes. As shown therein, a flange 22' of a wheel hub 12' includes an outer brake rotor mounting surface 22B' having a generally tapered profile which is tapered radially inwardly from a point D1 to a point D2 along the surface of the flange 22' by a predetermined distance Y. The distance Y is the axial distance defined between the point D1 and the point D2 on the outer surface of the flange 22' of the wheel hub 12'.

The illustrated bearing unit 14 is a pregreased, sealed-for life, one-piece cartridge style bearing pack assembly and includes an outwardly extending flange 28. The flange 28 has a plurality of circumferentially spaced mounting bolt receiving holes 28A formed therein (only one of such mounting bolt receiving holes 28A is illustrated in FIG. 1). A mounting bolt (not shown) is disposed in each of the mounting bolt receiving holes 28A to secure the bearing unit 14 to a non-rotatable component of the vehicle, such as the steering knuckle (not shown), so as to rotatably support the vehicle wheel hub 12 relative thereto. Alternatively, the bearing unit 14 can be other than illustrated if desired. For example, the bearing unit 14 can be of the type having a pair of bearing elements, either ball bearings or tapered roller bearings, disposed between an inner bearing race or cup and an outer bearing race or cup.

The vehicle wheel hub and bearing assembly 10 further includes a spanner nut 30 which is installed on a threaded portion of the vehicle wheel hub 12 adjacent the opened inboard end 16 thereof. When installed, the spanner nut 30 is operative to secure the bearing unit 14 on the vehicle wheel hub 12 and to preload the bearing unit 14. To accomplish this, the spanner nut 30 is provided with internal threads 30A. The internal threads 30A of the spanner nut 30 mate with external threads 12A provided on the vehicle wheel hub 12 adjacent the inboard end 16 thereof. As is known, the spanner nut 30 is tightened against the inboard end surface 14A of the bearing unit 14 to a predetermined torque in order to exert a predetermined clamp load on the bearing unit 14.

Figure 2:
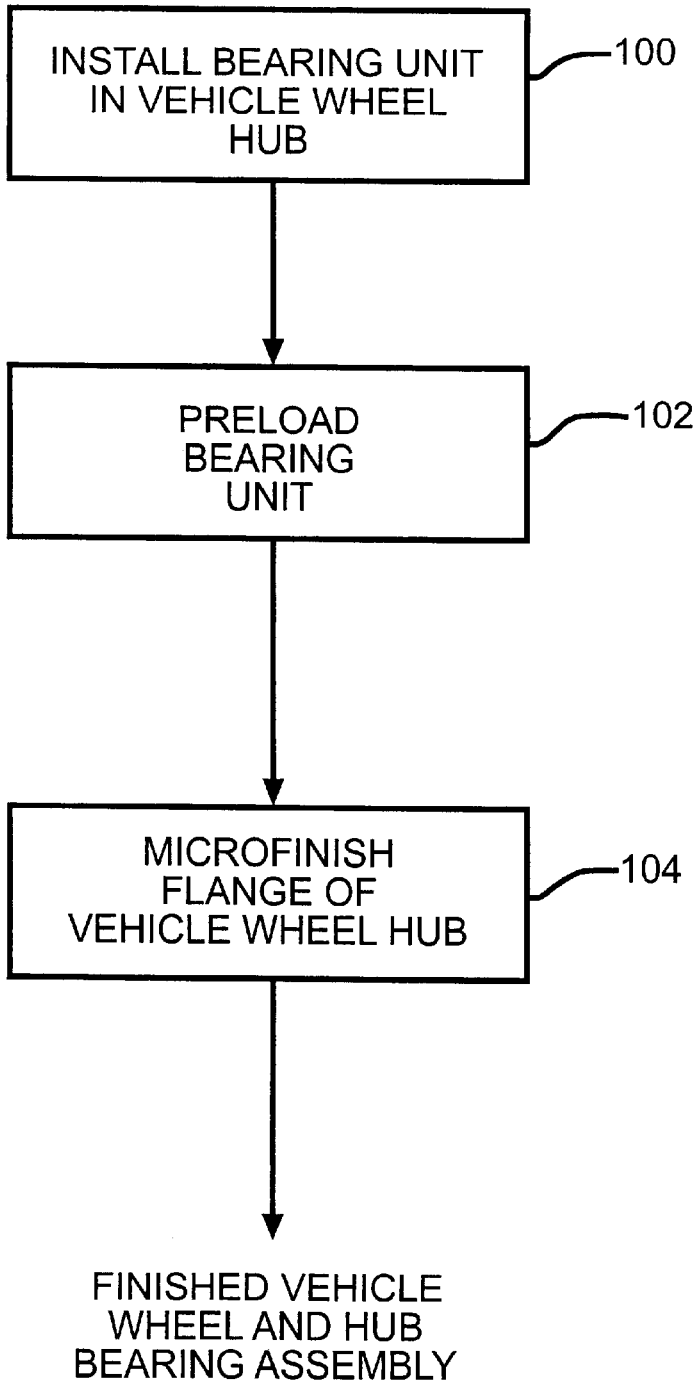
FIG. 2 is a schematic diagram of a microfinishing machine for producing the vehicle wheel hub and bearing unit assembly in accordance with this invention.
Figure 3:
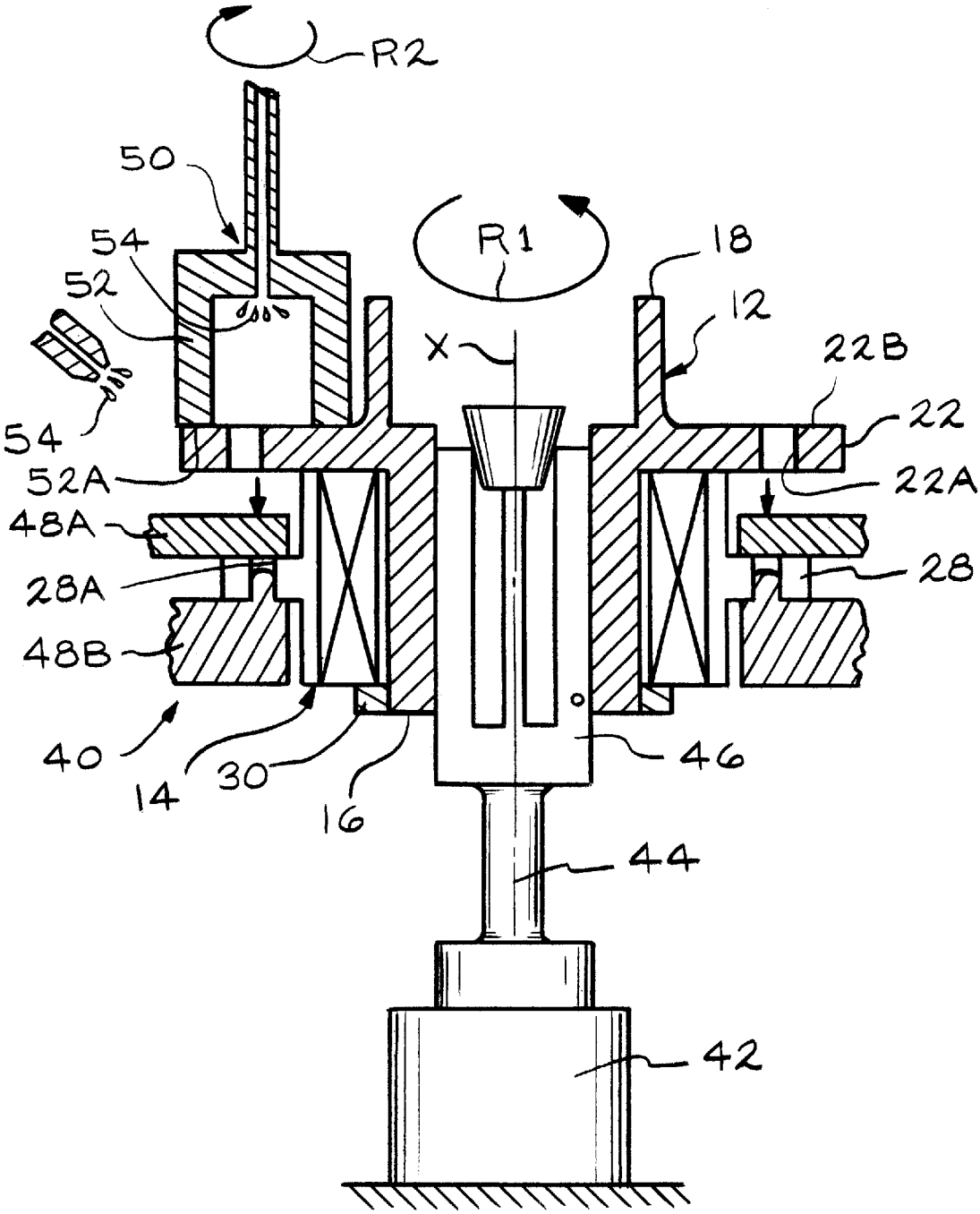
FIG. 3 is a block diagram illustrating a sequence of steps for producing a vehicle wheel hub and bearing unit assembly in accordance with the present invention.

Turning now to FIGS. 2 and 3, the method and apparatus for producing the first embodiment of the vehicle wheel hub and bearing unit assembly 10 of this invention will be discussed. Initially, in step 100, the bearing unit 14 is pressed onto the bearing surface 24 of the vehicle wheel hub 12 and advanced (to the right in FIG. 1) until an outboard end surface 15A of an inner race 15 of the bearing unit 14 engages the bearing seat surface 24B of the wheel hub 12. Next, in step optional 102, the spanner nut 30 is installed on the threaded end of the vehicle wheel hub 12 and tightened against an inboard end surface 15B of the inner race 15 of the bearing unit 14 so as to exert a predetermined clamp load on the bearing unit 14. Alternatively, the bearing unit 14 can be preloaded in a manner other than illustrated. For example, the bearing unit 14 can be preloaded using a bolt 110 and a nut 112 as illustrated in FIG. 11; using an "in-process" half-shaft (not shown) and a nut (not shown) which are used in the assembling of the vehicle and are not used just to produce the wheel hub and bearing assembly 10' of this invention; or any other suitable method which is effective to secure the wheel hub 12 and the bearing unit 14 together and to preload the bearing unit 12.

Following this, in step 104, the vehicle wheel hub and bearing unit assembly 10 is subjected to a microfinishing process. To accomplish this, the assembled vehicle wheel hub and bearing unit assembly 10 is supported on a suitable fixture, such as the fixture 40 shown in FIG. 3, and is subjected to a microfinishing operation. The illustrated fixture 40 includes a motor 42, a flexible torque drive 44, an expandable mandrel 46, an upper clamp member 48A a lower clamp member 48B, and a mircofinishing assembly 50.

In the illustrated embodiment, the flexible torque drive member 44 is effective to rotate the vehicle wheel hub 12 relative to the bearing unit 14 so as to minimize the external forces exerted on the wheel hub 12 and/or the bearing unit 14 which can deflect or load the wheel hub 12 and/or the bearing unit 14 and thereby affect the axial runout thereof. The expanding mandrel 46 is effective to operatively connect the flexible torque drive member 44 to the wheel hub 12. Alternatively, the fixture 40 can be other than illustrated if desired. However, the particular fixture 40 that is used is preferably selected so as minimize the external forces exerted on the wheel hub 12 and/or the bearing unit 14 which can deflect or load the wheel hub 12 and/or the bearing unit 14 and which can affect the axial runout thereof. For example, the fixture could include a wheel hub which is rotated using a drive nut (not shown) which drives off of the bearing retention nut; or a friction drive wheel member (not shown) which is located anywhere on the wheel hub.

Once the vehicle wheel hub and bearing unit assembly 10 is supported on fixture 40, the motor 42 is actuated and the mandrel 46 is operative to rotate the vehicle wheel hub 12 relative to the bearing unit 14 in a first direction as indicated by arrow R1 in FIG. 3. Preferably, at the same time, the microfinishing assembly 50 is actuated whereby a microfinishing wheel 52 engages the outer brake rotor mounting surface 22B of the vehicle wheel hub 12 so as to microfinish machine the outer brake rotor mounting surface 22B and thereby produce the vehicle wheel hub and bearing assembly 10 of this invention. The microfinishing wheel 52 is rotated in a second opposite direction as indicated by arrow R2 in FIG. 3. Since the vehicle wheel hub 12 is rotated in a first direction and the microfinishing wheel 52 is rotated in a second opposite direction during step 104, the outer brake rotor mounting surface 22B is machined relative to the longitudinal axis of rotation X of the vehicle wheel hub and bearing assembly 10. Alternatively, the direction R1 of rotation of the vehicle wheel hub 12 and/or the direction R2 of rotation of the microfinishing wheel 52 can be other than illustrated if desired.

Figure 5:
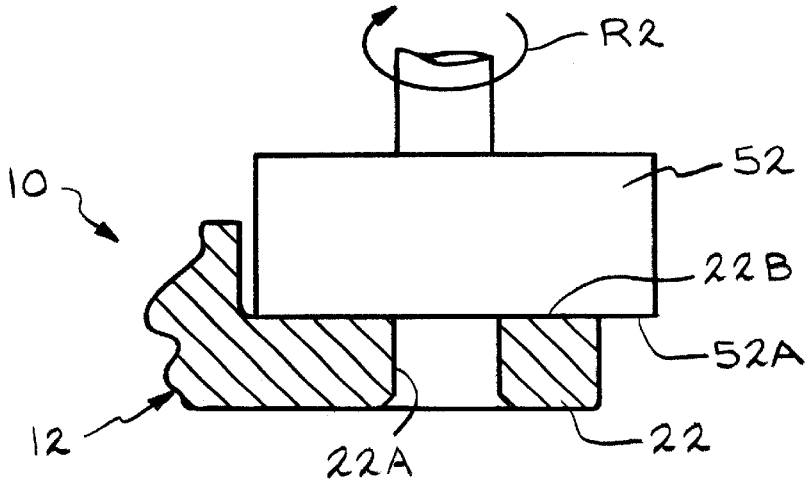
FIG. 5 is a partial sectional view illustrating the first microfinishing process of FIG. 2 for producing the first embodiment of a vehicle wheel hub and bearing unit assembly in accordance with this invention.

As best shown in FIG. 5, during step 104 an outer surface 52A of the microfinishing wheel 52 engages substantially the entire outer brake rotor mounting surface 22B of the wheel hub 12. Also, preferably, during step 104, a lubricating oil (shown at 54 in FIG. 2) is supplied to the outer brake rotor mounting surface 22B which is subjected to the microfinishing process to assist the microfinishing process. Alternatively, as will be discussed below, the profile and/or the area of the outer brake rotor mounting surface 22B can be other than illustrated, and/or the wheel hub 12 can have the associated lug bolts 26 installed therein during the microfinishing process if so desired.

Figure 6:
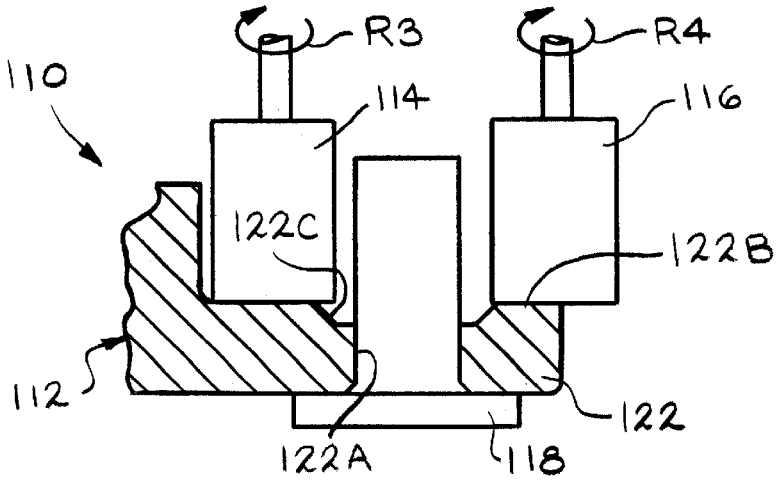
FIG. 6 is a partial sectional view illustrating a second microfinishing process for producing a second embodiment of a vehicle wheel hub and bearing unit assembly in accordance with this invention.

FIG. 6 illustrates a second machining process for producing a second embodiment of a vehicle wheel hub and bearing unit assembly 110 in accordance with this invention. As shown therein, an outer brake rotor mounting surface 122B of a flange 122 of a wheel hub 112 is subjected to a microfinishing process by a pair of spaced apart microfinishing assemblies 114 and 116 when lug bolts 118 (only one lug bolt 118 shown in FIG. 6) are installed in the associated lug bolt receiving holes 122A of the wheel hub 112.

As discussed above, during the microfinishing process, the wheel hub 112 is rotated in a first direction and the microfinishing assemblies 114 and 116 are rotated in a second opposite direction, as indicated by arrows R3 and R4. Thus, in this embodiment having the lug bolts 118 installed therein, only a portion of the entire brake outer brake rotor mounting surface 122B of the wheel hub 112 is microfinished machined. Also, as shown in FIG. 6, each of the lug bolt receiving holes 122A is provided with a slightly recessed or countersunk portion 122C adjacent the outer brake rotor mounting surface 122B of the wheel hub 112. Alternatively, the direction of rotation of the vehicle wheel hub 112 and/or the direction of rotation R3 and R4 of one or both of the microfinishing assemblies 114 and 116, respectively, can be other than illustrated if desired.

Figure 7:
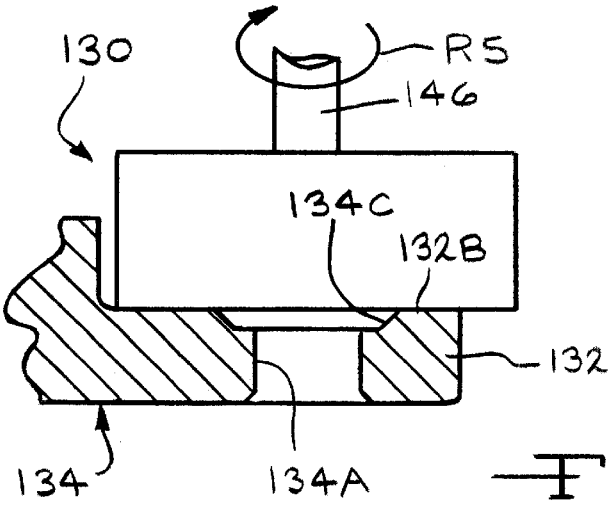
FIG. 7 is a partial sectional view illustrating a third microfinishing process for producing a third embodiment of a vehicle wheel hub and bearing unit assembly in accordance with this invention.

FIG. 7 illustrates a third microfinishing process for producing a third embodiment of a vehicle wheel hub and bearing unit assembly 130 in accordance with this invention. As shown therein, an outer brake rotor mounting surface 132B of a flange 132 of a wheel hub 134 is subjected to a microfinishing process by a single microfinishing assembly 146 without any lug bolts (not shown) installed in the associated lug bolt receiving holes 134A of the wheel hub 134.

As discussed above, during the microfinishing process, the wheel hub 134 is rotated in a first direction and the microfinishing assembly 134 is rotated in a second opposite direction, as indicated by arrow R5. Alternatively, the direction of rotation of the vehicle wheel hub 134 and/or the direction R5 of rotation of the microfinishing assembly 146 can be other than illustrated if desired. Thus, in this embodiment, substantially the entire outer brake rotor mounting surface 132B of the wheel hub 132 is microfinished without any lug bolts installed therein. Also, as shown in FIG. 7, each of the lug bolt receiving holes 134A is provided with a slightly recessed or countersunk portion 134C adjacent the outer brake rotor mounting surface 132B of the wheel hub 132.

Figure 8:
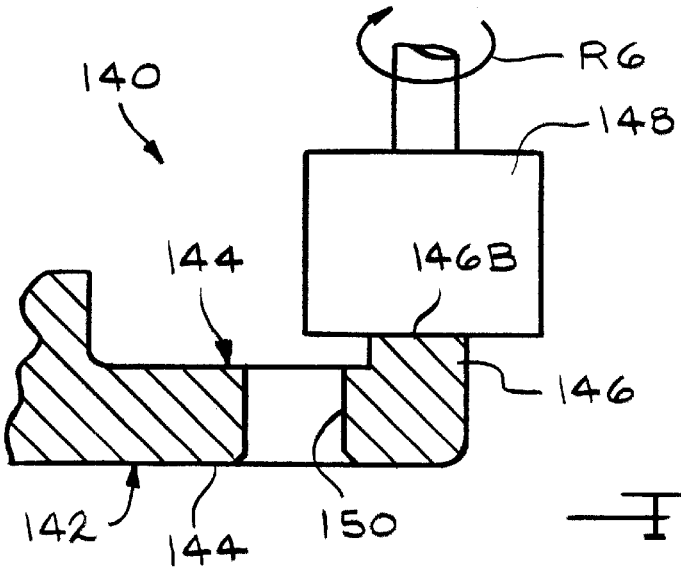
FIG. 8 is a partial sectional view illustrating a fourth microfinishing process for producing a fourth embodiment of a vehicle wheel hub and bearing unit assembly in accordance with this invention.

FIG. 8 illustrates a fourth microfinishing process for producing a fourth embodiment of a vehicle wheel hub and bearing unit assembly 140 in accordance with this invention. As shown therein, a wheel hub 142 includes a stepped flange 144 having an outer raised flange 146 which defines an outer brake rotor mounting surface 146B. In this embodiment, the outer brake mounting surface 146B of the raised flange 146 of the wheel hub 142 is subjected to a microfinishing process by a single microfinishing assembly 148 without any lug bolts (not shown) installed in the associated lug bolt receiving holes 150 of the wheel hub 142.

As discussed above, during the microfinishing process, the wheel hub 142 is rotated in a first direction and the microfinishing assembly 148 is rotated in a second opposite direction, as indicated by arrow R6. Alternatively, the direction of rotation of the vehicle wheel hub 142 and/or the direction R6 of rotation of the microfinishing assembly 148 can be other than illustrated if desired. Thus, in this embodiment, substantially the entire outer brake rotor mounting surface 146B of only the raised flange 146 of the stepped flange 144 of the wheel hub 142 is microfinished without any lug bolts installed therein.

Figure 9:
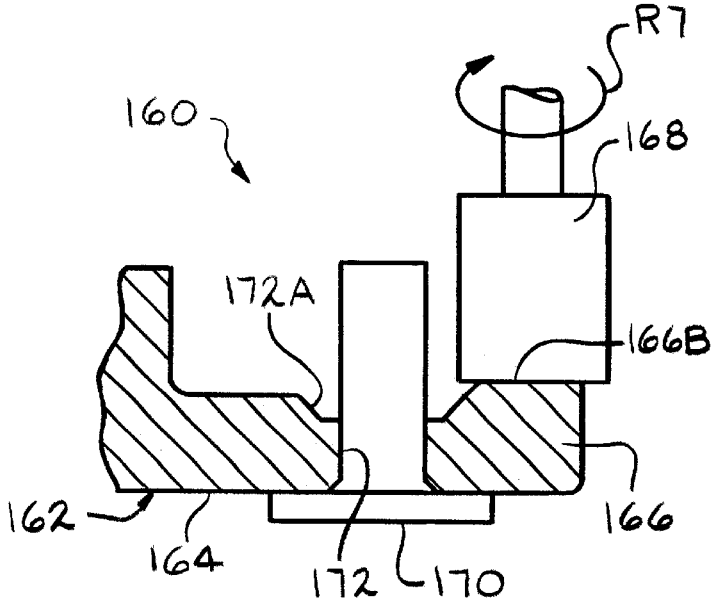
FIG. 9 is a partial sectional view illustrating a sixth microfinishing process for producing a fifth embodiment of a vehicle wheel hub and bearing unit assembly in accordance with this invention.

FIG. 9 illustrates a fifth machining process for producing a fifth embodiment of a vehicle wheel hub and bearing unit assembly 160 in accordance with this invention. As shown therein, a wheel hub 162 includes a stepped flange 164 having an outer raised flange 166 which defines an outer brake rotor mounting surface 166B. In this embodiment, the outer brake rotor mounting surface 166B of the raised flange 166 of the wheel hub 162 is subjected to a microfinishing process by a single microfinishing assembly 168 when lug bolts 170 (only one lug bolt 170 illustrated in FIG. 9) are installed in the associated lug bolt receiving holes 172 of the wheel hub 162.

As discussed above, during the microfinishing process, the wheel hub 162 is rotated in a first direction and the microfinishing assembly 168 is rotated in a second opposite direction, as indicated by arrow R7. Alternatively, the direction of rotation of the vehicle wheel hub 162 and/or the direction R7 of rotation of the microfinishing assembly 168 can be other than illustrated if desired. Thus, in this embodiment, substantially the entire outer brake rotor mounting surface 166B of only the raised flange 166 of the stepped flange 164 of the wheel hub 162 is microfinished when the lug bolts 170 are installed therein. Also, as shown in FIG. 9, each of the lug bolt receiving holes 172 is provided with a slightly recessed or countersunk portion 172A adjacent the outer surface of the stepped flange 164 of the wheel hub 162.

Figure 10:
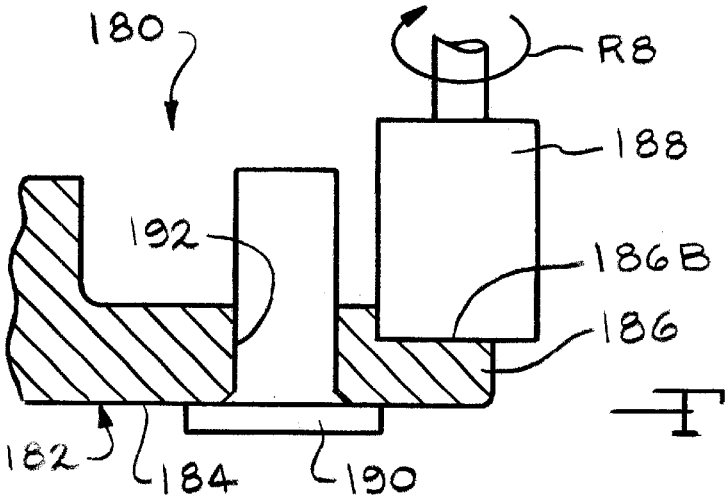
FIG. 10 is a partial sectional view illustrating a seventh microfinishing process for producing a sixth embodiment of a vehicle wheel hub and bearing unit assembly in accordance with this invention.

FIG. 10 illustrates a sixth microfinishing process for producing a sixth embodiment of a vehicle wheel hub and bearing unit assembly 180 in accordance with this invention. As shown therein, a wheel hub 182 includes a stepped flange 184 having a outer recessed flange 186 which defines an outer brake rotor mounting surface 186B. In this embodiment, the outer brake mounting surface 186B of the raised flange 186 of the wheel hub 182 is subjected to a microfinishing process by a single microfinishing assembly 188 when lug bolts 190 (only one lug bolt 190 illustrated in FIG. 10) are installed in the associated lug bolt receiving holes 192 of the wheel hub 182.

As discussed above, during the microfinishing process, the wheel hub 182 is rotated in a first direction and the microfinishing assembly 188 is rotated in a second opposite direction, as indicated by arrow R8. Alternatively, the direction of rotation of the vehicle wheel hub 182 and/or the direction R8 of rotation of the microfinishing assembly 188 can be other than illustrated if desired. Thus, in this embodiment, substantially the entire outer brake rotor mounting surface 186B of only the recessed flange 186 of the stepped flange 184 of the wheel hub 182 is microfinished when the lug bolts 190 are installed therein.

Figure 4:
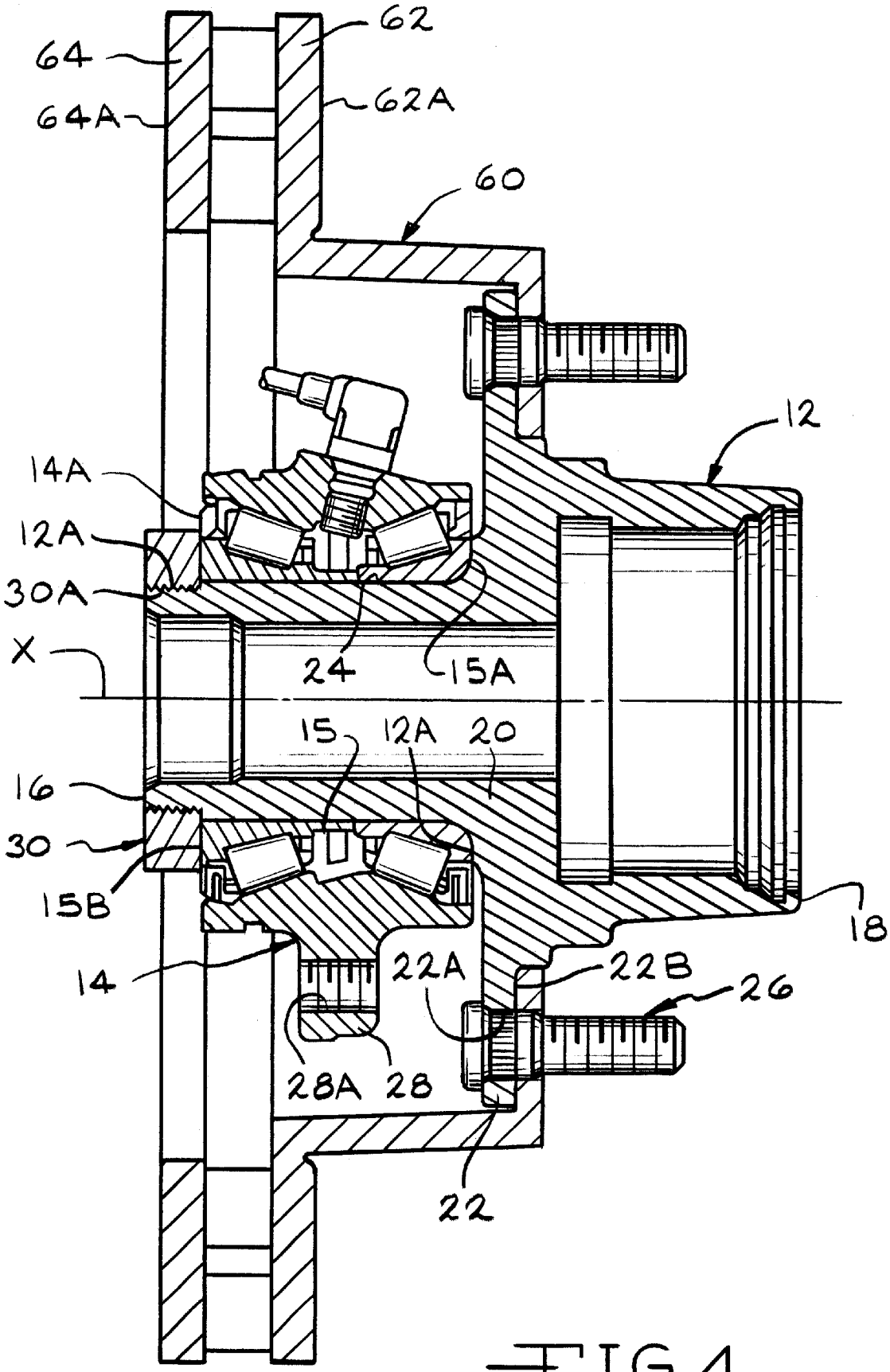
FIG. 4 is a sectional view of the vehicle wheel hub and bearing unit assembly illustrated in FIG. 1 including a brake rotor secured thereto.

One advantage of this invention is that the microfinishing finish machining operation utilizes a low pressure grinding or machining wheel which exerts minimal pressure onto the associated outer brake rotor mounting surface 22B, 122B, 132B, 146B, 166B, and 186B of the respective vehicle wheel hub 12, 112, 134, 142, 162, and 182. As a result, the axial runout along the microfinished surface of the outer brake rotor mounting surface of the vehicle wheel hub and bearing unit assembly of this invention is reduced compared to that of a conventional non-microfinished finish machined prior art vehicle wheel hub. For example, using the microfinishing process of the present invention can result in an axial runout along the outer brake rotor mounting surface of the vehicle wheel hub and bearing assembly of this invention which is consistently around 10 microns or smaller, and usually around 6 microns or smaller. As discussed above, a prior art wheel hub machined by a conventional lathe machining process can produce an axial runout therein can be as great as about 50 microns. As a result, as shown in FIG. 4, when a disc brake rotor 60 is mounted to the vehicle wheel hub and bearing unit assembly 10, the resulting total stack up axial runout of the outer surfaces 62A and 64A of the brake plates 62 and 64, respectively, is also reduced. In addition, the reduced axial runout of the vehicle wheel hub and bearing unit assembly of this invention simplifies the initial mounting and service mounting of the associated disc brake rotor since special attention to the particular orientation of the brake rotor with respect to the vehicle wheel hub and bearing unit assembly is not necessary.

Another advantage of this invention is that the use of the flexible torque drive is effective to minimize the external forces exerted on the wheel hub and/or the bearing unit which can deflect or load the wheel hub and/or the bearing unit and thereby affect the axial runout thereof. Also, depending upon the particular construction and application, the vehicle wheel hub and bearing unit assembly of this invention may be produced with a reduction in the number of manufacturing steps compared to that to produce the prior art vehicle wheel hub and bearing unit assembly.

Although this invention has been illustrated and described in connection with the particular vehicle wheel hub and bearing assembly disclosed herein, the invention can be used in connection with other vehicle wheel hubs and/or other bearing units. For example, the vehicle wheel hub can have a different structure than that illustrated in the drawings; the vehicle wheel hub could not have a spanner nut installed thereof, the vehicle wheel hub and bearing assembly can be used on a driven front/rear wheel end assembly; on a non-driven front/rear wheel end assembly, on a selectively driven two/four wheel driven wheel end assembly; and on a full time four wheel driven wheel end assembly.

In accordance with the provisions of the patent statutes, the principle and mode of operation of this invention have been described and illustrated in its preferred embodiments. However, it must be understood that this invention may be practiced otherwise than as specifically explained and illustrated without departing from its spirit or scope.

What is claimed is:

1. A method for producing a vehicle wheel hub and bearing unit assembly comprising the steps of:

(a) providing a vehicle wheel hub including a body having an inboard end, an outboard end, and a main body having an outwardly extending flange, the flange having a plurality of circumferentially spaced holes formed therein, the flange including an inner surface and an outer surface, at least a portion of the outer surface of the flange defining an outer brake rotor mounting surface of the vehicle wheel hub;

(b) providing a bearing unit adapted to be secured to a non-rotatable component of a vehicle so as to rotatably support the vehicle wheel hub relative thereto;

(c) assembling the bearing unit onto the vehicle wheel hub to produce a vehicle wheel hub and bearing unit assembly which defines a longitudinal axis;

(d) preloading the bearing unit;

(e) providing a microfinishing assembly having a microfinishing wheel;

(f) supporting the vehicle wheel hub and bearing assembly on the microfinishing assembly; and (g) subsequent to the step (f), operating the microfinishing assembly whereby the microfinishing wheel engages at least a portion of the outer brake rotor mounting surface of the vehicle wheel hub and bearing unit assembly to remove material therefrom and produce the finished vehicle wheel hub and bearing unit assembly, the outer brake rotor mounting surface being microfinished relative to the longitudinal axis of the vehicle wheel hub and bearing unit assembly such that the outer brake rotor mounting surface has an axial runout of about 10 microns or smaller.

2. The method according to claim 1 wherein prior to the step (g) the step of installing a fastening member in each of the holes in the flange of the wheel hub.

3. The method according to claim 1 wherein the step (a) includes providing a wheel hub having a plurality of circumferentially spaced non-threaded holes formed in the flange.

4. The method according to claim 3 wherein prior to the step (g) the step of installing a lug bolt in each of the holes in the flange of the wheel hub.

5. The method according to claim 1 wherein the flange includes a first outer surface spaced radially inwardly from the holes in the flange and a second outer surface spaced radially outwardly from the holes in the flange, at least the second outer surface defining an outer brake rotor mounting surface of the vehicle wheel hub, and in the step (g) operating the microfinishing assembly whereby the microfinishing wheel engages at least the second outer surface of the flange of the vehicle wheel hub and bearing unit assembly to remove material therefrom whereby at least the second outer surface of the flange of the wheel hub is microfinished relative to the longitudinal axis of the vehicle wheel hub and bearing unit assembly.

6. The method according to claim 1 wherein the flange includes a first outer surface spaced radially inwardly from the holes in the flange and a second outer surface spaced radially outwardly from the holes in the flange, the first and second outer surfaces defining an outer brake rotor mounting surface of the vehicle wheel hub, in the step (e) providing a microfinishing assembly having first and second microfinishing wheels, and in the step (g) operating the microfinishing assembly whereby the first and second microfinishing wheels engage the respective first outer surface and second outer surface of the flange of the vehicle wheel hub to remove material therefrom whereby the first and second outer surfaces of the flange of the wheel hub are microfinished relative to the longitudinal axis of the vehicle wheel hub and bearing unit assembly.

7. The method according to claim 1 wherein during the step (g) the microfinishing wheel produces a profile on the outer brake rotor mounting surface which is generally flat and generally perpendicular relative to the longitudinal axis.

8. The method according to claim 1 wherein during the step (g) the microfinishing wheel produces a profile on the outer brake rotor mounting surface which is generally non-flat and generally not perpendicular relative to the longitudinal axis.

9. The method according to claim 1 wherein the microfinishing assembly includes a flexible drive member which during the step (g) operatively rotates the vehicle wheel hub relative to the bearing unit.

10. The method according to claim 1 wherein during the step (g) the vehicle wheel hub is rotated in a first direction and the microfinishing wheel is rotated in a second direction opposite to the first direction.

11. The method according to claim 1 wherein during the step (g) substantially the entire outer brake rotor mounting surface of the vehicle wheel hub and bearing unit assembly is engaged by the microfinishing wheel.

12. The method according to claim 1 wherein the microfinishing assembly includes a pair of spaced apart microfinishing wheels.

13. A vehicle wheel hub and bearing unit assembly produced according to the method of claim 1.

14. A method for producing a vehicle wheel hub and bearing unit assembly comprising the steps of:

(a) providing a vehicle wheel hub including a body having an inboard end, an outboard end, and a main body having an outwardly extending flange, the flange having a plurality of circumferentially spaced holes formed therein, the flange including a first outer surface spaced radially inwardly from the holes and a second outer surface spaced radially outwardly from the holes, at least the second outer surface defining an outer brake rotor mounting surface of the vehicle wheel hub;

(b) installing a fastening member in each of the holes in the flange of the wheel hub;

(c) providing a bearing unit adapted to be secured to a non-rotatable component of a vehicle so as to rotatably support the vehicle wheel hub relative thereto;

(d) assembling the bearing unit onto the vehicle wheel hub to produce a vehicle wheel hub and bearing unit assembly which defines a longitudinal axis and which has a fastening member in each flange hole;

(e) preloading the bearing unit;

(f) providing a microfinishing assembly having at least one microfinishing wheel;

(g) supporting the vehicle wheel hub and bearing assembly on the microfinishing assembly; and (h) subsequent to the step (g), operating the microfinishing assembly whereby the microfinishing wheel engages at least the second outer surface of the flange of the vehicle wheel hub and bearing unit assembly to remove material therefrom and produce the finished vehicle wheel hub and bearing unit assembly, the second outer surface of the finished vehicle wheel and bearing unit assembly being microfinished relative to the longitudinal axis of the vehicle wheel hub and bearing unit assembly.

15. The method according to claim 14 wherein during the step (h) the second outer surface is microfinished relative to the longitudinal axis of the vehicle wheel hub and bearing unit assembly such that the outer brake rotor mounting surface has an axial runout of about 10 microns or smaller.

16. The method according to claim 14 wherein the microfinishing assembly includes a flexible drive member which during the step (h) operatively rotates the vehicle wheel hub relative to the bearing unit.

17. A vehicle wheel hub and bearing unit assembly produced according to the method of claim 14.

18. The method according to claim 17 wherein the step (f) includes providing first and second microfinishing wheels, and the step (h) includes operating the microfinishing assembly whereby the first and second microfinishing wheels engage the respective first outer surface and second outer surface of the flange of the vehicle wheel hub and bearing unit assembly to remove material therefrom and produce the finished vehicle wheel hub and bearing unit assembly, the first outer surface and the second outer surface of the finished vehicle wheel and bearing unit assembly being microfinished relative to the longitudinal axis of the vehicle wheel hub and bearing unit assembly.

19. A method for producing a vehicle wheel hub and bearing unit assembly comprising the steps of:

(a) providing a vehicle wheel hub including a body having an inboard end, an outboard end, and a main body having an outwardly extending flange, the flange having a plurality of circumferentially spaced holes formed therein, the flange including an inner surface and an outer surface, at least a portion of the outer surface of the flange defining an outer brake rotor mounting surface of the vehicle wheel hub;

(b) providing a bearing unit adapted to be secured to a non-rotatable component of a vehicle so as to rotatably support the vehicle wheel hub relative thereto;

(c) assembling the bearing unit onto the vehicle wheel hub to produce a vehicle wheel hub and bearing unit assembly which defines a longitudinal axis;

(d) preloading the bearing unit;

(e) providing a microfinishing assembly having a microfinishing wheel and a flexible drive member which is operative to rotate the vehicle wheel hub relative to the bearing unit;

(f) supporting the vehicle wheel hub and bearing assembly on the microfinishing assembly; and (g) subsequent to the step (f), operating the microfinishing assembly whereby the microfinishing wheel engages at least a portion of the outer brake rotor mounting surface of the vehicle wheel hub and bearing unit assembly to remove material therefrom and produce the finished vehicle wheel hub and bearing unit assembly, the outer brake rotor mounting surface being microfinished relative to the longitudinal axis of the vehicle wheel hub and bearing unit assembly.

20. The method according to claim 19 wherein during the step (h) the second outer surface is microfinished relative to the longitudinal axis of the vehicle wheel hub and bearing unit assembly such that the outer brake rotor mounting surface has an axial runout of about 10 microns or smaller.

21. A vehicle wheel hub and bearing unit assembly produced according to the method of claim 20.

* * * * *